US006873813B2

(12) United States Patent
Furukawa et al.

(10) Patent No.: US 6,873,813 B2
(45) Date of Patent: Mar. 29, 2005

(54) DEVELOPMENT METHOD AND IMAGE FORMATION APPARATUS

(75) Inventors: Kazuhiko Furukawa, Tenri (JP); Tadashi Iwamatsu, Nara (JP); Hiroyuki Hirakawa, Tenri (JP); Tetsuro Toyoshima, Kyoto (JP)

(73) Assignee: Sharp Kabuskiki Kaisha, Osaka (JP)

( * ) Notice: Subject to any disclaimer, the term of this patent is extended or adjusted under 35 U.S.C. 154(b) by 0 days.

(21) Appl. No.: 10/725,462

(22) Filed: Dec. 3, 2003

(65) Prior Publication Data

US 2004/0109707 A1 Jun. 10, 2004

Related U.S. Application Data

(63) Continuation of application No. 10/141,973, filed on May 10, 2002, now Pat. No. 6,681,091.

(30) Foreign Application Priority Data

May 11, 2001 (JP) ..... 2001-141076

(51) Int. Cl.[7] ..... G03G 15/06
(52) U.S. Cl. ..... 399/222; 399/53; 399/55
(58) Field of Search ..... 399/53, 55, 119, 399/222, 225, 228, 229, 230

(56) References Cited

U.S. PATENT DOCUMENTS 5,541,029 A * 7/1996 Iwata et al. ..... 430/45
5,920,747 A 7/1999 Takemoto et al.
5,937,228 A 8/1999 Shoji et al.
6,275,666 B1 8/2001 Furukawa et al.
6,480,691 B2 11/2002 Okada

FOREIGN PATENT DOCUMENTS

JP 2-191966 A 7/1990
JP 0300-4244 A 1/1991
JP 3-288873 A 12/1991
JP 11-258906 A 9/1999
JP P2001-75321 A 3/2001

* cited by examiner

*Primary Examiner*—Hoan Tran
(74) *Attorney, Agent, or Firm*—Birch, Stewart, Kolasch & Birch, LLP.

(57) ABSTRACT

The increasing ratio of development density to increase in potential difference between a photoreceptor and a development roller differs between the region where the potential difference is small and the region where the potential difference is large. The increasing ratio of development density at the region where the potential difference is small is smaller than the increasing ratio of development density at the region where the potential difference is large. Development is conducted under the developing characteristics in which the upper limit of the development density at the region where the increasing ratio of development density is small is at least 0.3.

1 Claim, 9 Drawing Sheets

DEVELOPMENT METHOD AND IMAGE FORMATION APPARATUS

This application is a Continuation of application Ser. No. 10/141,973, filed on May 10, 2002, now U.S. Pat. No. 6,681,091, the entire contents of which is hereby incorporated by reference and for which priority is claimed under 35 U.S.C. § 120; and this application claims priority of application Ser. No. 2001-141076 filed in Japan on May 11, 2002 under 35 U.S.C. § 119.

BACKGROUND OF THE INVENTION

1. Field of the Invention

The present invention relates to an image formation apparatus such as copiers and printers, and a development method using such image formation apparatus.

2. Description of the Background Art

A conventional image formation apparatus will be first described.

FIG. 12 is a schematic diagram of a conventional image formation apparatus based on the electrophotographic system. Referring to FIG. 12, the image formation apparatus includes a photoreceptor 1, a charger device 2, an exposure device 3, a developing device 4, a transfer device 6, a cleaner 7, and an optical discharger lamp 8. Photoreceptor 1 is arranged at substantially the center region of the image formation apparatus. Around photoreceptor 1 are disposed charger device 2, exposure device 3, developing device 4, transfer device 6, cleaner 7 and optical discharger lamp 8, sequentially in the direction of rotation of photoreceptor 1.

Exposure device 3 includes a semiconductor laser 301, a polygon mirror 302 for scanning a laser beam, and a lens system 303 to direct the laser beam in a desired shape and scanning speed onto photoreceptor 1 to form an image.

In operation, photoreceptor 1 has its surface charged to a predetermined potential level by charger device 2. Then, a latent image potential corresponding to image information is formed on photoreceptor 1. The electrostatic latent image formed on photoreceptor 1 is conveyed by the rotation of photoreceptor 1 to a development region that faces developing device 4.

In this development region, a development roller is disposed facing photoreceptor 1. The development roller carries a developer precharged to a desired value and having the layer thickness adjusted (referred to as "toner" hereinafter) at its surface. The toner is transferred onto photoreceptor 1 corresponding to the latent image pattern to render the image visible. Following visualization of the latent image potential on photoreceptor 1 by the toner, the toner image is conveyed to a transfer region located at transfer device 6 through the rotation of photoreceptor 1.

A transfer sheet P fed by a sheet feed device not shown is delivered to the transfer region to be synchronously brought into contact with the toner image on photoreceptor 1. A voltage of a polarity of either state corresponding to transferring the toner on photoreceptor 1 to transfer sheet P is applied to transfer device 6, whereby the toner image on photoreceptor 1 is transferred onto transfer sheet P. Transfer sheet P with the toner image is then delivered to have the image fused and fixed on transfer sheet P by a thermal fixing device (not shown). The untransferred toner remaining on photoreceptor 1 after passage of the transfer region is removed from photoreceptor 1 by cleaner 7. A refresh operation of potential is conducted by optical discharger lamp 8 to erase the residual charge of photoreceptor 1. Then, control returns to the initial process.

In the above-described electrophotographic image formation apparatus, characters and the like are binary-recorded by means of the presence/absence of dots based on the toner. In the case of a photographic image or the like, the halftone is expressed by pixels formed of a plurality of binary-recorded dots. If the number of dots in one pixel is increased in order to obtain more gray scale levels that can be represented, the pixel size will become larger. As a result, the resolution defined by the number of pixels is reduced.

To address this issue, various approaches have been employed to obtain more gray scale levels that can be expressed with one pixel without altering the pixel size. For example, the light-on time of the laser beam in the formation of a latent image of one dot is altered to change the size of one dot, or the intensity of the laser beam is altered to change the density of one dot. The technique related to pulse-width modification by altering the light-on time of the laser beam is disclosed in, for example, Japanese Patent Laying-Open No. 3-4244. This publication discloses that the controllability and stability of the gray scale can be improved at the image area of low image density by setting the spot diameter of the laser beam to not more than 0.7 times the dot pitch (63.5 $\mu$m for 400 dpi) to increase the contrast of the latent image potential.

There is now a greater demand for higher resolution in the market. For example, the resolution of approximately 1200 dpi is desired so that the area of slanted lines in a character or the like can be easily identified. It is also desired that one dot is formed at approximately 20 $\mu$m to improve the graininess of the highlight area.

If the writing pitch with the laser beam is reduced in accordance with higher resolution, the exposure spot must also be reduced. Consider the case of an isolated dot. Even if the exposure spot of laser is made smaller than the writing pitch, or even if the energy distribution thereof is sharp, the potential distribution will become gentle due to the diffusion of charge generated in the photoreceptor after exposure by laser. In other words, it is desirable that the potential at the surface of the photoreceptor corresponding to an isolated dot shown in FIG. 13A exhibits squareness as shown by the solid line in FIG. 13B. However, the potential corresponds to a gentle curve indicated by the chain dotted line due to charge diffusion. The potential distribution corresponding to the potential at the surface of the photoreceptor becomes gentler as the dot pitch becomes smaller. The peak value of potential (=potential difference for developing) becomes lower as indicated by the chain dotted line in FIG. 13B. Thus, an isolated dot can no longer be developed in a digital manner. An isolated dot can be developed only in an analog manner.

This issue will be described with reference to FIGS. 14–17.

FIG. 14 represents the potential distribution at the toner layer face of one dot of a latent image on the photoreceptor, formed by pulse-width modification, in the case where the dot pitch and the exposure spot are relatively large. In FIG. 14, broken line t represents the potential level of development commencement corresponding to the general developing characteristics shown in FIG. 17 whereas broken line s represents the potential level of development saturation corresponding to the same general developing characteristics shown in FIG. 17.

In the case where the dot pitch and the exposure spot are both relatively large, dots in the lower gray scale level will not be developed since the development commence level t is not reached as shown in FIG. 14. In the invention of the aforementioned Japanese Patent Laying-Open No. 3-4244, the laser spot is reduced in order to solve this problem, whereby dots in the lower gray scale level can be developed stably since the development saturation level s is exceeded as shown in FIG. 15.

However, if the dot pitch is reduced to a level so as to allow realization of the resolution of approximately 1200 dpi according to the approach disclosed in Japanese Patent Laying-Open No. 3-4244, the potential distribution of the toner layer face by a latent image will be as shown in FIG. 16 even if the laser spot is reduced. Dots of the upper gray scale level will be developed in the density increasing region (the potential between development commence level t and development saturation level s), not in the density saturation region. In this density increasing region, any slight variation in the potential of the toner layer determined by the potential distribution in the toner layer, the charged amount of toner, or the toner attaching amount of a latent image will cause variation in the dot diameter. It is therefore difficult to realize stable gray scale levels particularly in a low density region.

SUMMARY OF THE INVENTION

In view of the foregoing, an object of the present invention is to provide a development method and image formation apparatus aimed to improve picture quality and stability in development by forming a small dot stably with no graininess to realize stable gray scale in a low density region, and obtaining sufficient density in a high density region, in forming an image of high resolution.

In a development method according to an aspect of the present invention conducted by an image formation apparatus including an electrostatic latent image carrier carrying an electrostatic latent image and a developer carrier carrying a developer at its surface, facing the electrostatic latent image carrier at a developing region, the increasing ratio of development density to increase of the potential difference between the electrostatic latent image carrier and the developer carrier differs between the region where the potential difference is small and the region where the potential difference is large. Development is carried out under the developing characteristics in which the increasing ratio of development density in a region where the potential difference is small is smaller than the increasing ratio of development density in a region where the potential difference is large, and the upper limit of the development density in the region where the increasing ratio of development density is small is at least 0.3.

Since the increasing ratio of development density is small in the region where the potential difference between the electrostatic latent image carrier and the developer carrier is small according to the development method of the present aspect, variation in dots can be suppressed. Furthermore, sufficient image density can be achieved since the increasing ratio of development density is large in the region where the potential difference between the electrostatic latent image carrier and the developer carrier is large.

Accordingly, by forming small dots stably with no graininess to realize a stable gray scale in the low density region, and achieve sufficient density in the high density region, the picture quality can be improved and development can be carried out stably in the formation of an image at high resolution.

The upper limit of the development density in a region where the increasing ratio of development density is small is set to at least 0.3. This is because an isolated dot can be formed stably if the upper limit is at least 0.3. The development density in the present specification refers to the optical density of an image subjected to development.

In the development method of the present aspect, development is carried out under the developing characteristics in which the upper limit of the development density in the region where the increasing ratio of development density is small is at least 0.5.

Accordingly, an isolated dot can be formed stably even if there is a great change in potential caused by environment modification.

According to another aspect of the present invention, in a development method conducted by an image formation apparatus including an electrostatic latent image carrier carrying an electrostatic latent image and a developer carrier carrying a developer at its surface, facing the electrostatic latent image carrier at a developing region, development is conducted using a developer of a small increasing ratio of development density to increase of the potential difference between the electrostatic latent image carrier and the developer carrier, followed by development using a developer of a larger increasing ratio of development density to increase of the potential difference.

In the development method of the present aspect, development is carried out using a developer of small increasing ratio of development density to increase of the potential difference between the electrostatic latent image carrier and the developer carrier, and then development is carried out using a developer of larger increasing ratio. Therefore, the increasing ratio of development density in a region where the potential difference is small can be set smaller than the increasing ratio of development density in a region where the potential difference is large. Variation in dots can be suppressed since the increasing ratio of development density is small in the region where the potential difference between the electrostatic latent image carrier and the developer carrier is small. Also, since the increasing ratio of development density is large in the region where the potential difference between the electrostatic latent image carrier and developer carrier is large, sufficient image density can be obtained.

Accordingly, by forming small dots stably with no graininess to realize a stable gray scale in the low density region, and achieve sufficient density in the high density region, the picture quality can be improved and development can be carried out stably in the formation of an image at high resolution.

According to a further aspect of the present invention, an image formation apparatus includes an electrostatic latent image carrier carrying an electrostatic latent image, and first and second developer carriers respectively carrying a developer at its surface, and facing the electrostatic latent image carrier at a developing region. The increasing ratio of development density to increase of the potential difference between the first developer carrier and the electrostatic latent image carrier is smaller than the increasing ratio of development density to increase of the potential difference between the second developer carrier and the electrostatic latent image carrier. The first developer carrier is arranged upstream of the second developer carrier in a travel direction of the electrostatic latent image carrier.

By disposing the first developer carrier upstream of the second developer carrier in the travel direction of the electrostatic latent image carrier in the image formation apparatus of the present aspect, development can be carried using a developer of a small increasing ratio of development density to increase of the potential difference between the electrostatic latent image carrier and the developer carrier, and then development can be carried out using a developer of a larger increasing ratio of development density to increase of the potential difference. Accordingly, the increasing ratio of development density in a region where the potential difference between the electrostatic latent image carrier and the developer carrier is small becomes smaller than the increasing ratio of development density in a region where the potential difference is large. Since the increasing ratio of development density is small in the region where the potential difference between the electrostatic latent image carrier and the developer carrier is small, variation in dots can be suppressed. Also, sufficient image density can be achieved since the increasing ratio of development density is large in the region where the potential difference is large.

Accordingly, by forming small dots stably with no graininess to realize a stable gray scale in the low density region, and achieve sufficient density in the high density region, the picture quality can be improved and development can be carried out stably in the formation of an image at high resolution.

In the image formation apparatus of the present aspect, the specific charge of the developer on the first developer carrier is preferably larger than the specific charge on the second developer carrier.

Accordingly, the increasing ratio of development density to increase of the potential difference between the first developer carrier and the electrostatic latent image carrier can be set small, and the increasing ratio of development density to increase of the potential difference between the second developer carrier and the electrostatic latent image carrier can be set large.

The image formation apparatus of the present aspect preferably includes a charge generation device applying desired charge to at least one of the developer on the first developer carrier and the second developer carrier by applying charge of a single polarity.

Even if the same toner is used for two developing devices, charge can be applied by the charge generation device so that the specific charge of the developer on the first developer carrier is larger than the specific charge on the second developer carrier.

In the image formation apparatus of the present aspect, the resistance value of the first developer carrier is smaller than the resistance value of the second developer carrier.

The potential of the developer on the developer carrier becomes smaller in proportion to a larger resistance of the developer carrier. By setting the resistance of the first developer carrier smaller than the resistance of the second developer carrier, the specific charge of the developer on the first developer carrier can be set larger than the specific charge of the developer on the second developer carrier even if the same toner is employed for two developing devices.

According to still another aspect of the present invention, an image formation apparatus includes an electrostatic latent image carrier carrying an electrostatic latent image, and a developer carrier carrying a developer at its surface, and facing the electrostatic latent image carrier at a developing region. A developer of a small increasing ratio of development density to increase of the potential difference between the electrostatic latent image carrier and the developer carrier and a developer of a larger increasing ratio of development density to increase of the potential difference are formed on a single developer carrier.

In the image formation apparatus of the present aspect, uniform formation of small dots and the optical density of a solid black image can both be achieved with one developing device. Accordingly, the number of structural components can be reduced, and the overall size of the apparatus can be reduced.

The image formation apparatus of the present aspect further includes a charge generation circuit applying charge of a single polarity to the developer on the developer carrier. The developer carrier includes a high resistance portion and a low resistance portion provided alternately in the travel direction of the developer carrier.

By employing a developer carrier in which a high resistance portion and a low resistance portion are provided alternately, uniform formation of small dots and the optical density of a solid black image can both be achieved with one developing device. Accordingly, the number of structural components can be reduced, and the overall size of the apparatus can be reduced.

The image formation apparatus of the present aspect further includes a charge generation device applying a charge of a single polarity to the developer on the developer carrier. The developer carrier includes a high electrostatic capacitance portion and a low electrostatic capacitance portion provided alternately in the travel direction of the developer carrier.

By using a developer carrier having the high electrostatic capacitance portion and the low electrostatic capacitance portion provided alternately, uniform formation of small dots and the optical density of a solid black image can both be achieved with one developing device. Accordingly, the number of structural components can be reduced, and the overall size of the apparatus can be reduced.

The image formation apparatus of the present aspect further includes a charge generation device applying charge of a single polarity to the developer on the developer carrier. The image formation apparatus further includes a movable support member in contact with the developer carrier at a plane opposite to the plane where the developer carrier faces the charge generation device. The support member includes two sets of electrode patterns in the travel direction of the support member. Different voltages are applied to the two sets of electrode patterns.

By applying different voltages to the two sets of electrode patterns, uniform formation of small dots and the optical density of a solid black image can both be achieved with one developing device. Accordingly, the number of structural components can be reduced, and the overall size of the apparatus can be reduced.

In the image formation apparatus of the present aspect, the developer on the developer carrier is a mixture of two sets of developers having different average grain size. The set of the developer of smaller average grain size has higher flowability than the set of the developer of larger average grain size.

Following formation of small dots using a developer of low specific charge, development is carried out using a developer of a large specific charge. Therefore, small dots can be formed stably in a low density region, and sufficient solid black density can be achieved in the high density region.

In the image formation apparatus of the present aspect, the developer on the developer carrier is a mixture of two sets of developers having different average charge. The set of the developer of the large average charge has flowability higher than that of the set of the developer of smaller average charge.

Following formation of small dots using the developer of smaller specific charge, development is carried out using a developer of a larger specific charge. Therefore, small dots can be formed stably at the low density region, and sufficient solid black density can be obtained at the high density region.

In the image formation apparatus of the present aspect, preferably a voltage having a direct-current voltage overlaid with an alternating voltage is applied to the developer carrier.

Since development can be carried out using a developer of large specific charge after small dots are formed using a developer of low specific charge, small dots can be formed stably in the low density region. In the high density region, sufficient solid black density can be achieved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described hereinafter with reference to the drawings.

First Embodiment

Figure 1:
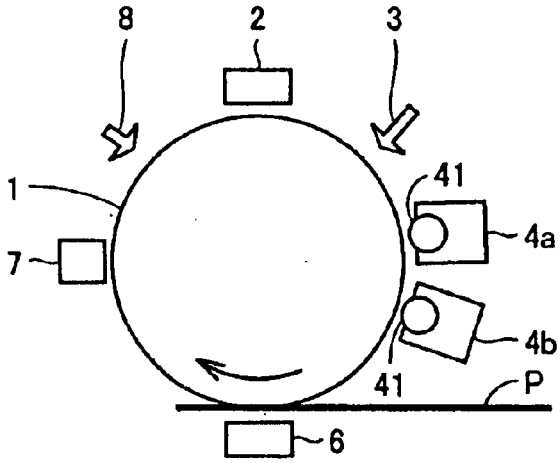
FIG. 1 is a schematic diagram of an image formation apparatus according to an embodiment of the present invention.

Referring to FIG. 1, an image formation apparatus includes a photoreceptor 1, a charger device 2, an exposure device 3, developing devices 4*a* and 4*b*, a transfer device 6, a cleaner 7, and an optical discharger lamp 8. Photoreceptor 1 is arranged substantially at the center of the image formation apparatus. Charger device 2, exposure device 3, developing devices 4*a* and 4*b*, transfer device 6, cleaner 7 and optical discharger lamp 8 are sequentially arranged around photoreceptor 1 in the direction of rotation thereof.

Photoreceptor 1 has an underlayer, a carrier generation layer CGL, and a carrier transfer layer CTL sequentially applied on a conductive base of metal or resin. The outermost carrier transfer layer CTL is applied in a thin film with polycarbonate as the main component, and formed of a material whose inclination of the charge generation amount with respect to the exposure amount is relatively gentle.

In operation of the image formation apparatus of the present embodiment, photoreceptor 1 is charged to a desired potential, for example to −600V, by charger device 2. A latent image potential corresponding to the image information is formed by exposure device 3.

The electrostatic latent image formed on photoreceptor 1 is rotated and conveyed to a region of developing device 4*a* facing development roller 41. In the developing region, a conductive development roller 41 having its surface formed of an elastic member is brought into contact with photoreceptor 1. Toner charged to a desired value and having the layer thickness regulated is transferred onto photoreceptor 1 corresponding to a latent image pattern according to a process that will be described afterwards to render the image visible. Following visualization of the latent image potential of photoreceptor 1 by the toner, the toner image is transferred to a transfer region where transfer device 6 is located by rotation of photoreceptor 1.

Then, a transfer sheet P fed by a sheet feed device not shown is delivered to the transfer region to be synchronously brought into contact with the toner image on photoreceptor 1. Voltage of either polarity corresponding to the state where the toner of photoreceptor 1 is to be transferred onto transfer sheet P is applied to transfer device 6, whereby the toner image on photoreceptor 1 is transferred onto transfer sheet P. Transfer sheet P with the toner image is then delivered generally to a thermal fixing device (not shown) to have the toner fused and fixed, followed by discharge The untransferred toner remaining on photoreceptor 1 after passage of the transfer region is removed by cleaner 7. A refresh operation of potential is conducted by optical discharger lamp 8 to erase the residual charge of photoreceptor 1. Then, control returns to the initial process.

The structure of developing devices 4*a* and 4*b* will be described in detail here.

Figure 2:
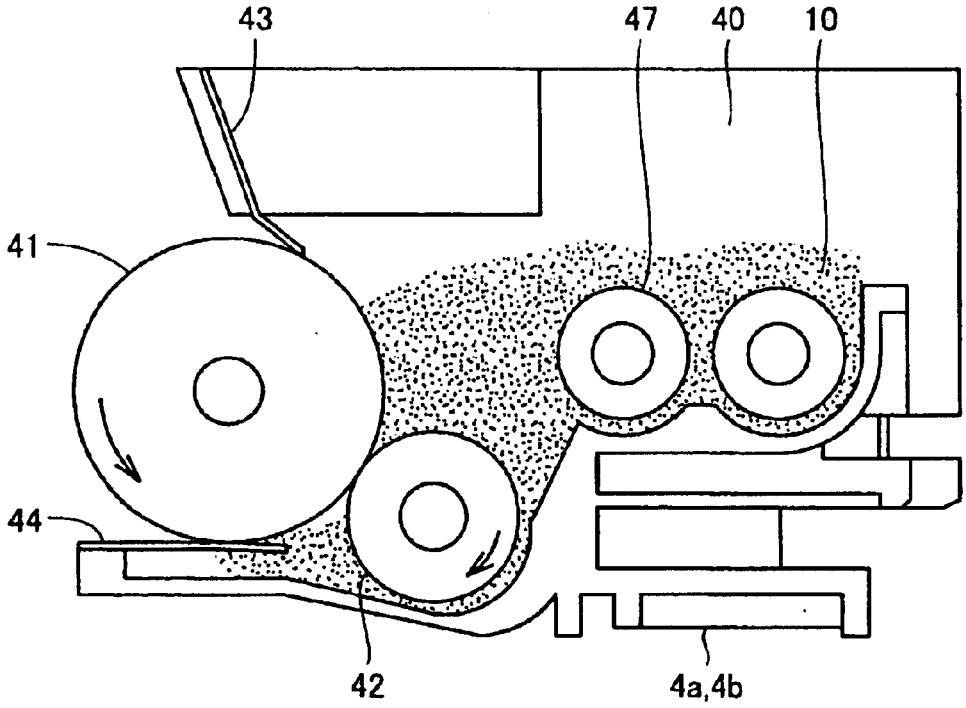
FIG. 2 is a schematic sectional view of a structure of a developing device used in the image formation apparatus of the first embodiment.

Referring to FIG. 2, toner 10 stored in a toner tank (also referred to as "hopper" hereinafter) 40 of developing devices 4*a* and 4*b* are carried to the neighborhood of development roller 41 by means of a screw 47.

Development roller 41 has a structure in which a semiconductive elastic layer of 8 mm in thickness is provided on the surface of a stainless steel rotation axis of, for example, 18 mm in diameter. The medium of the semiconducting elastic layer is formed of a material having carbon black distributed in urethane resin. The value of the resistance of the elastic layer is adjusted by the distributed amount of carbon black.

A toner feed roller 42 abuts against development roller 41. Toner feed roller 42 rotates in a direction opposite to the direction of rotation of development roller 41 at the area opposite to development roller 41. Toner feed roller 42 is formed of a material similar to that of development roller 41. The electrical resistance of toner feed roller 42 is adjusted by a resistance-adjusting material similar to that of development roller 41. A foamed medium is employed for toner feed roller 42 to further increase its elasticity. The amount of the foaming agent to further increase the elasticity for toner feed roller 42 is more than that applied for development roller 41.

Voltage from a bias power supply not shown is applied to toner feed roller 42. A bias voltage is applied so as to press toner 10 against development roller 41. For example, if toner 10 is of negative polarity, then a high level of bias voltage towards a greater negative state is applied.

As development roller 41 rotates, toner 10 supplied to development roller 41 by means of toner feed roller 42 is transported to the abutting position between a blade 43 which is a member that regulates the toner layer thickness and development roller 41.

Blade 43 formed of a stainless steel plate of 0.1 mm has a cantilevered spring plate structure. The free end of blade 43 abuts against development roller 41. Accordingly, toner 10 supplied to development roller 41 has the amount of charge and thickness adjusted to an appropriate level depending upon the predetermined set pressure and set position of blade 43. Voltage from a bias power supply not shown in applied to blade 43. The bias voltage is applied to press toner 10 against development roller 41. For example, if the toner is of negative polarity, a bias voltage corresponding to a further negative state or a bias voltage so as to achieve the same potential as development roller 41 is applied.

The undeveloped toner on development roller 41 not used in the development process is returned to developing devices 4*a* and 4*b* by means of rotation of development roller 41. The undeveloped toner on development roller 41 is discharged by a discharger device 44 arranged in front of toner feed roller 42. The toner falls off into hopper 40 by the pressing-contact with roller 42 to be recollected for reusage.

Discharger device 44 is an elastic member in the form of a thin plate. The portion of discharger device 44 in contact with the developer carrier via a developer layer is formed of a low-resistance material or metal material whose resistance is not more than 10 kΩ. Alternatively, discharger device 44 may be a member in the form of a roller. The portion of discharger device 44 in contact with the developer carrier via the developer layer is formed of a low-resistance material or metal material whose resistance is not more than 10 kΩ. Discharger device 44 in the shape of a roller member is advantageous in that charge present in the dielectric layer on development roller 41 can be removed in addition to the residual toner not used for development being removed from development roller 41.

In the case where an elastic member plate is employed for discharger device 44, one end of the elastic member plate is fixed to developer layer 4*a* or 4*b* to appropriately abut against development roller 41. The surface of the free end of the elastic member plate of discharger device 44 is pressed into contact with development roller 41 through the spring performance of the elastic body. A bias voltage Vd from a power supply circuit not shown is applied to this elastic member plate, whereby the charge on development roller 41 is removed after development. Also, the collected toner is discharged and removed. Voltage Vd may be the level of ground potential (0V), or an alternating voltage whose potential difference from development roller 41 is approximately ±800V.

Development roller 41 has a volume resistance of $10^7$Ω·cm, a rubber hardness of 54 degrees in Ascar C hardness, and a surface roughness Rz of 2. Development roller 41 has a contacting width of approximately 2.0 mm with respect to photoreceptor 1. Development roller 41 rotates at the peripheral speed of 70 mm/second.

Toner 10 is a small particle of 7 μm in average grain size, having carbon black and a charge control agent added to the base of stylene-acryl copolymer. Toner 10 is formed into a toner layer of approximately one layer, having the pack density of approximately 50% by means of blade 43.

Through the usage of the charge control agent, toner 10 in developing device 4*a* is adjusted to have an average specific charge of approximately −50 μC/g, and toner 10 in developing 4*b* is adjusted to have an average specific charge of approximately −20 μC/g. The following Table 1 shows the difference in the developing devices. The toner charging method and specific charge of the second to fifth embodiments that will be described afterwards are also shown in Table 1.

TABLE 1

| | | Developer Carrier | Toner Charging Method | Specific Charge |
|---|---|---|---|---|
| Embodiment 1 | developing device 4a | $10^7$ Ω · cm | friction | Approximately-50 μC/g |
| Embodiment 1 | developing device 4b | $10^7$ Ω · cm | friction | Approximately-20 μC/g |
| Embodiment 2 | developing device 4c | $-10^7$ Ω · cm | charge generation device | Approximately-60 μC/g |
| Embodiment 3 | developing device 4d | $10^9$ Ω · cm | charge generation device | Approximately-35 μC/g |
| Embodiment 4 | developing device 4e | $10^5/10^9$ Ω · cm | charge generation device | Approximately-45 μC/g |
| Embodiment 5 | developing device 4f | $10^8$ Ω · cm/pair electrode | charge generation device | Approximately-45 μC/g |

The present embodiment is characterized in that two developing devices 4*a* and 4*b* are employed, each storing a different type of toner with different average specific charge.

As examples of voltages applied to respective members during image formation, development roller 41 is set to −300V, feed roller 42 to −400V (development roller potential −100V), blade 43 of developing device 4*a* to −350V (development roller potential −50V), and blade 43 of developing device 4*b* to −320V (development roller potential −20V).

Using the above-described image formation apparatus, a dot was formed for every 4 pitches at an exposure pitch of 21 μm in the range of 150 mm in the laser scanning direction and 10 mm in the rotation direction of photoreceptor 1 using a laser of approximately 30 μm in spot diameter ($1/e^2$) on the surface of photoreceptor 1. The diameter of 100 dots respectively at 3 sites, i.e., at the left end, center, and right end sites in the laser scanning direction as well as variation of the dots were calculated. The exposure energy was adjusted so that the dot diameter is approximately 20 μm.

The obtained results of the average dot diameter at the center region (calculated as a diameter of a circle equivalent to the area of the dot developed region), variation in the average dot diameter (substantially, average dot diameter at the right end–average dot diameter at the left end), and the average value of the variation in the dot diameter at the three sites (3 σ/average dot diameter) are shown in Table 2.

Table 2 also shows corresponding values of other embodiments that will be described afterwards.

TABLE 2

| | Developing Device | Center Average Size (μm) | Variation in Dot Average Value (μm) | Variation | Solid Black Density |
|---|---|---|---|---|---|
| Embodiment 1 | developing device 4a → developing device 4b | 19 | 3 | 0.49 | 1.52 |
| Embodiment 2 | developing device 4c → developing device 4b | 20 | 2 | 0.43 | 1.50 |
| Embodiment 3 | developing device 4c → developing device 4d | 20 | 4 | 0.40 | 1.45 |
| Embodiment 4 | developing device 4e | 20 | 4 | 0.50 | 1.41 |
| | Developing device 4e/AC develop voltage | 20 | 3 | 0.46 | 1.42 |
| Comparative Example | developing device 4a | 20 | 3 | 0.48 | 1.05 |
| | developing device 4b | 19 | 12 | 0.61 | 1.55 |

It is appreciated that variation in the average dot diameter based on site is 3 μm, and the average value of the dot diameter variation at the three sites (3 σ/average dot diameter) is 0.49 in the present embodiment. Even though the dots are small, an image with small variation in the dot diameter based on site and of uniform dot diameter can be obtained. The optical density of the solid black image is 1.52 when the overall potential of photoreceptor 1 is 0V. This value satisfies the desired level for black.

According to the present embodiment, a low density image region can be formed stably with graininess improved. Also, sufficient density for the solid black region can be obtained.

For the sake of comparison with the above results, experiments based on a comparative example set forth below was also carried out.

Similar evaluation was conducted with the peripheral speed of rotation of the development roller set to 140 mm/seconds corresponding to the case where only developing device 4*a* is used and the case where only developing device 4*b* is used. The results are shown together in the previous Table 2.

It is appreciated from the results of Table 2 that, when only developing device 4*a* is employed, variation in the average dot diameter was 3 μm and the average value of variation was 0.48, all of favorable levels. However, the optical density of a solid black image was 1.05, not reaching the desired level.

In the case where only developing device 4*b* is employed, the obtained optical density of the solid black region was the sufficient level of 1.55. However, variation in the average dot diameter was 12 μm, and the variation in the average value was 0.61. It is appreciated that variation in the average dot diameter based on site as well as the neighborhood dot diameter variation both exceed the satisfactory level. A low density image cannot be formed stably.

Figure 3:
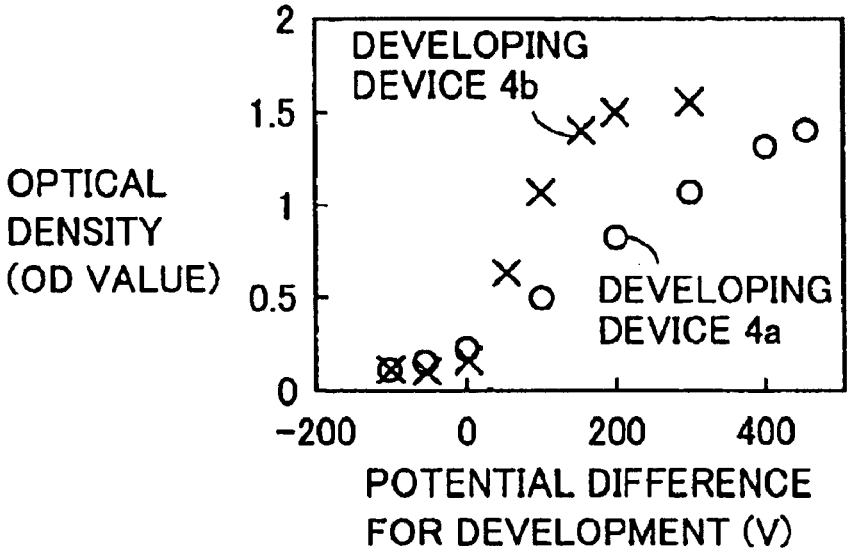
FIG. 3 shows the relationship between the potential difference for development and the optical density in the case where only a developing device 4*a* is employed and the case where only a developing device 4*b* is employed.

The amount of development with respect to the potential difference for development (referred to as "development γ" hereinafter) was evaluated for respective cases where only developing device 4*a*, only developing device 4*b*, and both developing devices 4*a* and 4*b* are operated. The characteristic shown in FIG. 3 is obtained corresponding to the case where only developing device 4*a* and only developing device 4*b* is operated. The characteristic shown in FIG. 4 is obtained when both developing devices 4*a* and 4*b* are operated.

Figure 4:
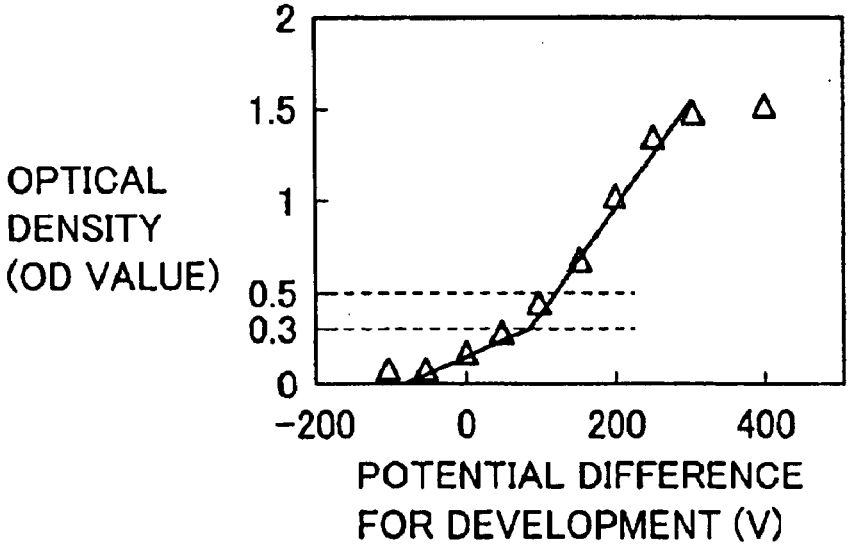
FIG. 4 shows the relationship between the potential difference for development and the optical density in the case where both developing devices 4*a* and 4*b* are employed.

In the graphs of FIGS. 3 and 4, the applied voltage to development roller 41 is sequentially altered with photoreceptor 1 not charged and maintained at 0V in the present measurement. Here, (photoreceptor potential (0V))—(development roller potential) is plotted along the abscissa whereas the optical density of a sheet on which an image is formed with the same density on the entire plane (OD value: development density) is plotted along the ordinate. It is well known that the same drawing can be obtained by taking (photoreceptor potential)—(development roller potential) along the abscissa with the potential of development roller 41 fixed and the charging potential of photoreceptor 1 sequentially altered.

It was assumed that the substantial potential difference for development is approximately 50 to 100V from the density of the developed dots.

It is possible to consider from FIG. 3 that, since the inclination of development γ is great in the vicinity of the potential difference for dot development in the case where development is carried out using only developing device 4*b*, the developing amount sharply reflects the potential distribution of photoreceptor 1 or the charged amount distribution of toner 1, resulting in greater variation in the dot diameter. In the case where only developing device 4*a* is used, inclination of development γ is small in the vicinity of the potential difference of dot development. It is therefore possible to consider that response to the aforementioned distribution is low, so that variation in dot diameter is small. However, sufficient density cannot be obtained even in the region corresponding to the potential difference of solid black since the inclination of development γ is small.

In the case where development is carried out with both developing devices 4*a* and 4*b* operated, the inclination of development γ is small in the region where the potential difference for development is small, and large in the region where the potential difference for development is large, as shown in FIG. 4. It is considered that, by forming such development γ characteristics, dots can be formed stably in the region where the dot density is low such as the low density image region (i.e., the region of small potential difference for development), and sufficient image density can be obtained in the region where the dot density is high such as the high density image region (i.e., the region where the potential difference for development is large).

The reason why variation becomes smaller when the inclination of development γ is small will be described hereinafter with reference to FIG. 5.

Figure 5:
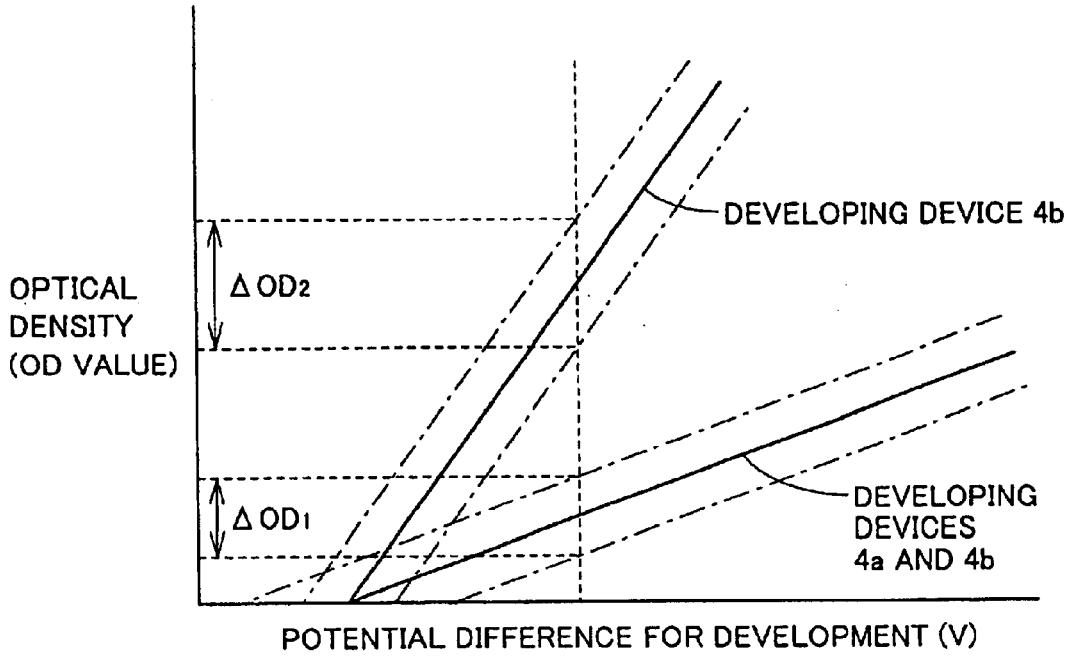
FIG. 5 is a diagram to describe that variation in dots is reduced by a smaller inclination of development $\gamma$.

In the graph of FIG. 5, the solid lines represent actually measured values. The chain dotted lines indicate the variation range of the actually measured values. In the case where the inclination is great as in the case where only developing device 4*b* is used, the range $\Delta OD_2$ of variation occurrence when viewed from a certain potential difference for development is relatively large. In contrast, when the inclination is small such as in the case where both developing devices 4*a* and 4*b* are used, the variation occurrence range $\Delta OD_1$ when viewed from a certain potential difference for development indicated by the chain dotted line is relatively smaller. It is therefore appreciated that variation becomes smaller when the inclination of development γ is smaller.

From the results of the present experiment, it is found that an isolated dot can be formed stably if the optical density is at least 0.3 for the region where the inclination of development γ is small. It is also found that the optical density is preferably at least 0.5 for the region where development γ is small taking into account a large change in potential caused by environment modification.

Second Embodiment

Figure 6:
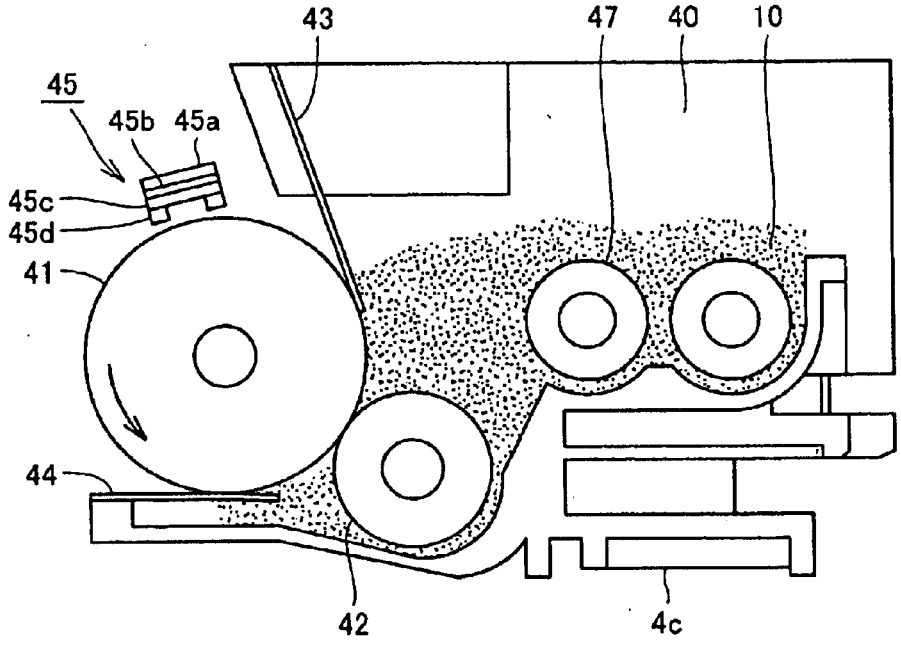
FIG. 6 is a schematic sectional view of a structure of a developing device employed in an image formation apparatus according to a second embodiment of the present invention.

Referring to FIG. 6, the developing device of the present embodiment differs in structure from the developing device of the first embodiment in that a charge generation device 45 is provided downstream of blade 43 in a rotation direction of development roller 41.

Charge generation device 45 has an electrode 45*b*, an insulation layer 45*c* and an electrode 45*d* sequentially stacked on an insulative support substrate 45*a*. Charge generation device 45 serves to increase the amount of charge of toner 10 by having the charge generated in the neighborhood of electrode 45*d* being attracted to the surface direction of the toner layer by an electric field based on the bias voltage and the surface potential of the toner layer to be applied to toner 10.

The remaining structure of the present embodiment is the substantially similar to that of the first embodiment. Corresponding components have the same reference characters allotted, and description thereof will not be repeated.

In the operation of the present embodiment, a bias voltage of −400V (development roller potential −100V) with the alternating voltage of ±2 kV at the cycle of 2 kHz is applied to electrode 45*b* of charge generation device 45. A bias voltage identical to that of electrode 45*b* (i.e., −400V) is applied to electrode 45*d*. Toner 10 is identical to toner 10 employed in developing device 4*b* already described. The toner layer formed by blade 43 is charged to approximately −20 μC/g. The toner layer is conveyed to a position facing charge generation device 45. The surface potential of the toner layer is charged up to approximately 60V (approximately −60 μC/g) while passing the facing region. The toner layer is then conveyed to the development region to enter the developing process. The sequent operation is similar to that of the first embodiment.

Variation in dot diameter similar to that of the first embodiment was evaluated using developing device 4*c* of the second embodiment instead of developing device 4*a* of the first embodiment shown in FIG. 1. The average dot diameter variation was 2 μm, and the average value in variation was 0.43. It is appreciated that small dots can be formed stably and uniformly. Also, the optical density of a solid black image is 1.50, satisfying the desired level corresponding to black.

By using developing device 4*c* with charge generation device 45 provided, the same toner 10 can be employed for both developing devices 4*c* and 4*b*. It is therefore not necessary to prepare two types of toner 10. This eliminates the possibility of toner 10 being erroneously supplied with the other toner 10 in the resupply operation of toner 10. Also, a slight improvement in the dot diameter variation is exhibited. This means that an image of a more preferable level can be formed. The reason why variation is improved is set forth below. By increasing the charge amount of toner 10 using charge generation device 45 of developing device 4*c*, the specific charge becomes larger than that of toner 10 in developing device 4*a*, whereby the inclination of development γ is further reduced. Also, variation in the charge amount by the frictional charge during the layer formation is reduced and becomes smaller than the variation in the charge amount of toner 10 by the frictional charge of development device 4*a*. It is likely that reduction in the variation of the developed dots is attributed to such events.

Third Embodiment

A developing device 4*d* employed in the image formation apparatus of the present embodiment differs in structure from developing device 4*c* of the second embodiment in that the resistance of development roller 41 is $10^9 \Omega \cdot cm$. With this developing device 4*d*, the specific charge of toner 10 charged by charge generation device 45 is approximately −35 μC/g.

The remaining structure of the third embodiment is substantially similar to that of the previous first embodiment. Therefore, description thereof will not be repeated.

Evaluation of the dot diameter variation similar to that of the first embodiment was conducted using developing device 4*d* and developing device 4*c* instead of developing device 4*b* and developing device 4*a* of the first embodiment. It is appreciated from the result that small dots can be formed stably and uniformly, wherein the average dot diameter variation is 4 μm and the average value in variation is 0.40. The obtained optical density of a solid black image is 1.45, satisfying the desired level for black.

In the toner charging operation, some of the charge (Ir) of single polarity supplied to the toner layer reaches the surfaces of the development roller without being attached to toner 10, and flows to the rotation axis through the elastic layer. Therefore, a potential corresponding to the resistance value (Rr) of the development roller is generated. Charge generation device 45 continues to supply charge until the toner layer surface potential (Vs) corresponding to the potential (Vr) of development roller 41 and the toner layer potential (Vt) reaches the level of bias voltage (Vb). Therefore, the relationship of Vs=Vb=Vr+Vt is established.

Since Vr=Rr×Ir here, a larger resistance value (Rr) of development roller 41 causes a larger potential (Vr) of development roller 41, and a smaller toner layer potential (Vt). Since the toner layer potential (Vt) is substantially proportional to the toner charge amount, the specific charge of toner 10 on development roller 41 that has a large resistance value (Rr) becomes smaller. This allows the formation of a toner layer having a different specific charge even if the respective set voltages and the like of charge generation device 45 of development device 4*d* are completely identical.

By employing developing device 4*c* (FIG. 6) and developing device 4*d* with charge generation device 45, the same toner 10 can be used for both developing devices 4*c* and 4*d*. It is no longer necessary to prepare two types of toner 10. Also, the possibility of erroneously using the wrong toner 10 in the resupply operation of toner 10 can be eliminated. Furthermore, developing devices 4*c* and 4*d* are favorable from the standpoint of fabrication and cost since only the resistance value of development roller 41 differs.

Too high the resistance value of development roller 41 for developing device 4*d* is not preferable due to the influence of the potential caused by the current flowing through the elastic layer not flowing out before the time of development, or the potential caused by the current associated in the travel of toner 10 from development roller 41 to photoreceptor 1 during development. The upper limit of the resistance of development roller 41 depends upon the capacitance component of development roller 41 and photoreceptor 1, and the transfer time from the charging of the toner layer up to the developing region. If the toner layer is too thick, the charge supplied from charge generation circuit 45 will not reach the surface of development roller 41. This means that there will be no difference in the toner layer potential even if the resistance differs, disallowing formation of a toner layer of different specific charge. Therefore, it is preferable that the thickness of the toner layer on development roller 41 is approximately 1 to 2.5 layers of toner 10.

Fourth Embodiment

Figure 7:
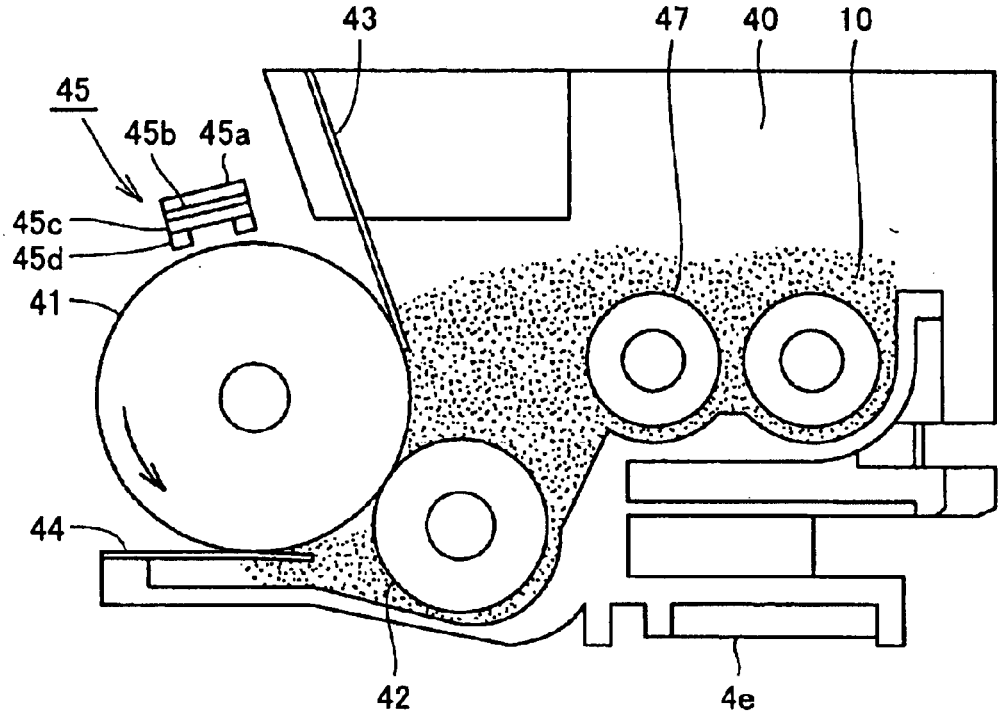
FIG. 7 is a schematic sectional view of a structure of a developing device employed in an image formation apparatus according to a fourth embodiment of the present invention.

Referring to FIG. 7, the developing device of the fourth embodiment differs in structure from the second embodiment shown in FIG. 6 in that development roller 41 has alternate portions of different resistance values in the direction of rotation.

Figure 8:
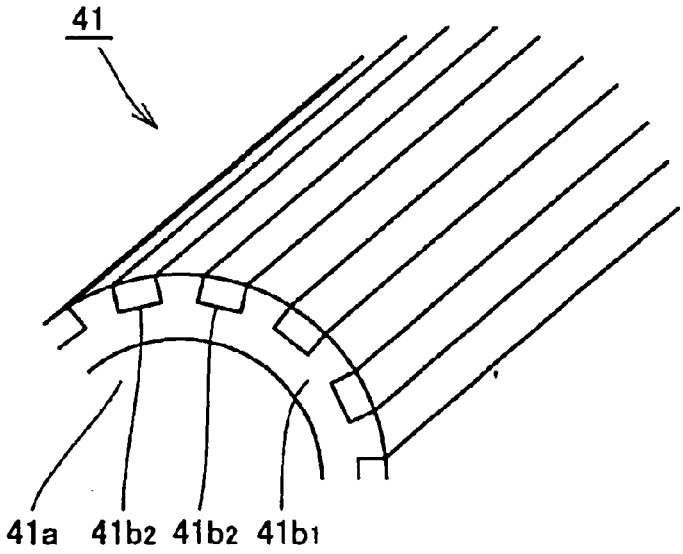
FIG. 8 is an enlarged perspective view of an elastic layer of a development roller.

Referring to development roller 41 of FIG. 8, a sheet is wound around the surface of rotation axis 41*a*. This sheet has an elastic layer 41*b*$_2$ of the high resistance of $10^9\Omega\cdot$cm provided in stripes at the pitch of 1 mm at the base of an elastic layer 41*b*$_1$, of the low resistance of $10^5\Omega\cdot$cm.

The remaining structure of the present embodiment is substantially similar to that of the second embodiment. The same components have the same reference characters allotted, and description thereof will not be repeated.

In the present embodiment, evaluation of the dot diameter variation similar to that of the first embodiment with conducted by rotating development roller 41 at the speed of 140 mm/second using only developing device 4*e*. It was found that small dots can be formed rather uniformly, wherein the variation of the average dot diameter is 4 $\mu$m and the average value of variation is 0.50. The obtained optical density of a solid black image is 1.41, satisfying the desired level as black.

Although the specific charge of the toner layer corresponding to the resistance value of development roller 41 is not defined, it is considered that an advantage similar to that described with reference to the third embodiment is obtained based on the fact that the specific charge of the entire toner layer after charging with charge generation device 45 was approximately −45 $\mu$C/g.

Evaluation was conducted of the dot diameter variation similar to that described previously by operating developing device 4*e* according to the above-described conditions, and applying a development bias voltage which is the direct-current voltage of −300V overlaid with the rectangular voltage of ±200V at the cycle of 1.5 kHz and duty ratio of 1:1 to development roller 41. As a result, variation in the average dot diameter was 3 $\mu$m and the average value of variation was 0.46. It is appreciated that variation is improved than in the case where development is conducted with only the direct-current voltage. Thus, small dots can be formed stably and uniformly. The obtained optical density of a solid black image was 1.42, satisfying the desired level for black.

Although the reason why variation is improved by using a voltage overlaid with a rectangular voltage is not definite, possible reasons are set forth below. Following the transfer and development of toner 10 having large specific charge at a narrow gap prior to entering the developing region, i.e., following the reliable development of small dots with a toner layer of small increasing ratio of development density to increase of the potential difference for development, development is performed using toner 10 of small specific charge at the developing region (it is assumed that there is substantially no transfer of toner 10 from development roller 41 to photoreceptor 1). Therefore, a developing state similar to that of the third embodiment is achieved. It is thus assumed that variation has been improved.

By virtue of developing device 4*e*, uniform formation of small dots and the optical density of a solid black image can both be accomplished with one developing device 4*e*. Accordingly, the number of structural components can be reduced, and the overall size of the apparatus can be made more compact.

Figure 9:
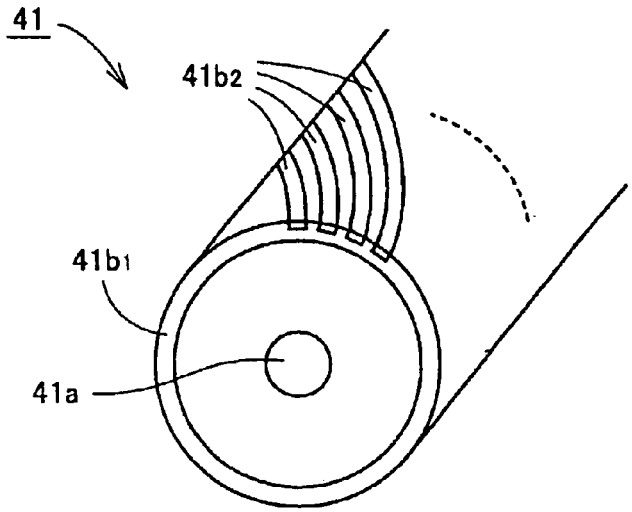
FIG. 9 is a perspective view of a structure in which a high resistance portion and a low resistance portion are provided alternately in an angled manner.

The foregoing description is based on a development roller 41 having a low resistance portion and a high resistance portion provided alternately in the direction orthogonal to the moving direction of development roller 41. It is more preferable to provide the low resistance portion and the high resistance portion in an angled manner (in a spiral manner) as shown FIG. 9. It is to be noted that, when a dot region and a solid black region are mixed in the axial direction of development, more development current will flow to the solid black region. In the case where a high resistance portion and a low resistance portion are provided alternately in a direction at right angles to the moving direction of development roller 41, the development current will move according to this pitch, whereby the effective development bias will change. This may alter the size or density of the dots. This variation can be alleviated by providing the low resistance portion and the high resistance portion alternately in an angled manner with respect to the moving direction of development roller 41.

A similar effect can be achieved by using a member of high permittivity and a member of low permittivity instead of the low resistance member and the high resistance member. This is because a toner layer formed of toner 10 having high specific charge on the member of high permittivity and toner 10 having small specific charge on the member of low permittivity can be provided.

A development roller 41 having an elastic sheet wound around rotation axis 41*a* is employed in the present embodiment. An operation similar to that described above can be realized by driving an elastic sheet in the form of a belt.

Fifth Embodiment

Figure 10:
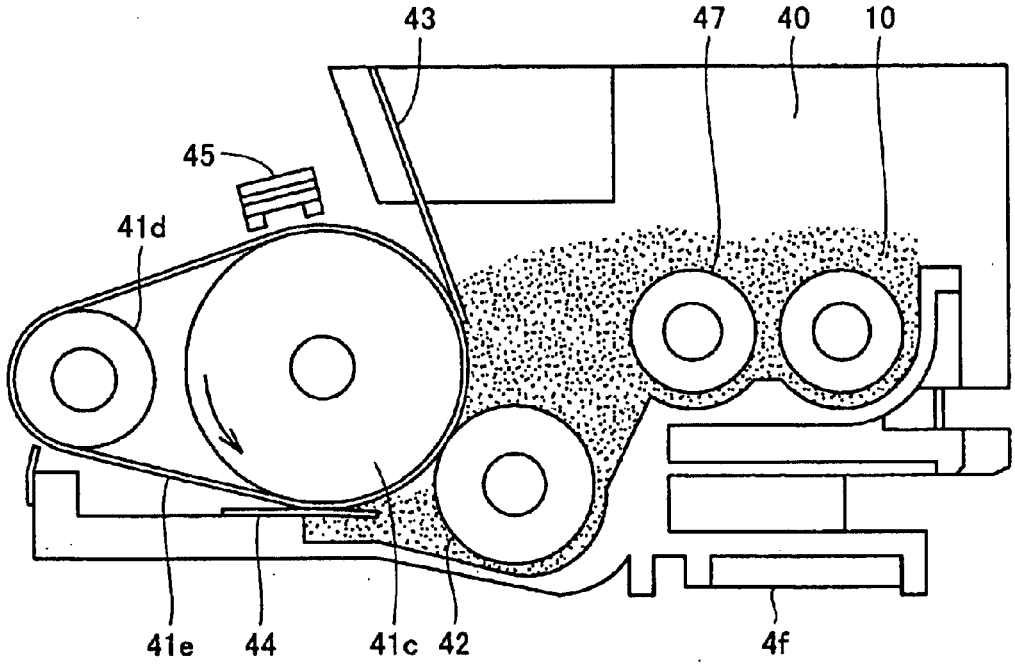
FIG. 10 is a schematic sectional view of a structure of a developing device employed in an image formation apparatus according to a fifth embodiment of the present invention.

Referring to FIG. 10, the structure of the fifth embodiment differs from the structure of the first embodiment in that a development belt 41*e* is employed as a developer carrier. Development belt 41*e* is supported by a belt support roller 41*c* and a development bias roller 41*d*.

Figure 11:
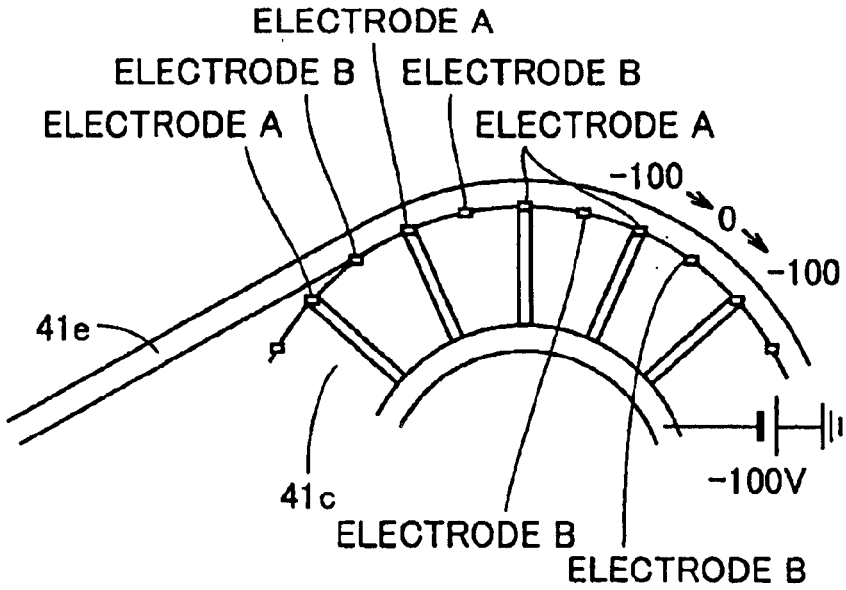
FIG. 11 is an enlarged view of a structure of a belt support roller.
Figure 12:
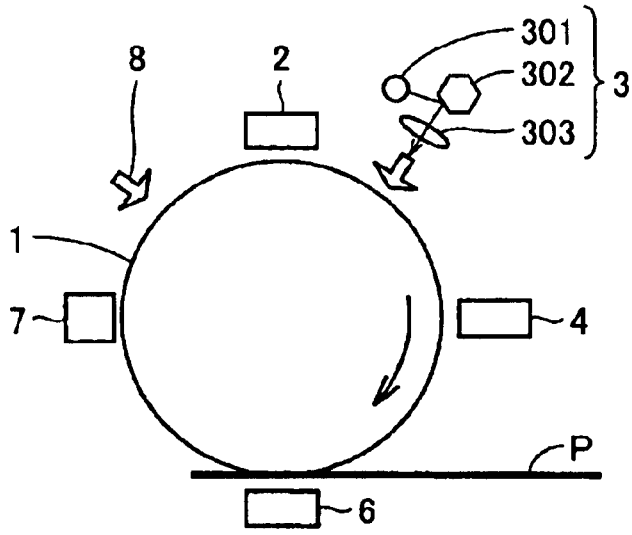
FIG.12 PRIOR ART
FIG. 12 is a schematic diagram of a conventional image formation apparatus.
Figures 13A, 13B:
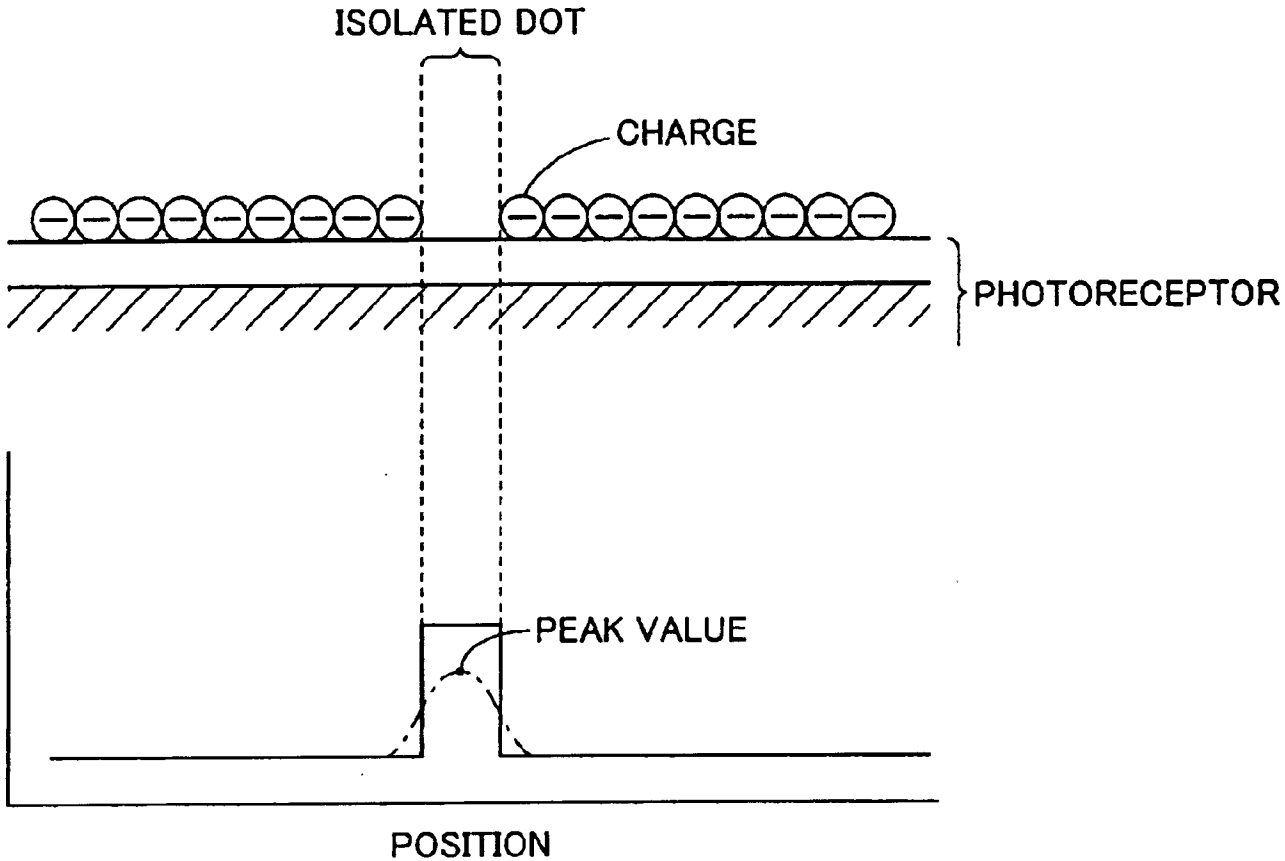
FIGS. 13A and 13B are diagrams to describe the potential at the surface of a photoreceptor in an isolated dot region.
Figure 14:
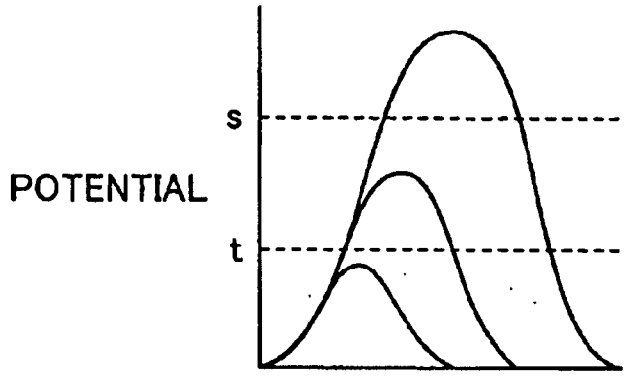
FIG. 14 shows the potential distribution at the toner layer face of one dot by a latent image on a photoreceptor, formed by pulse-width modification, in the case where the dot pitch and the exposure spot are large.
Figure 15:
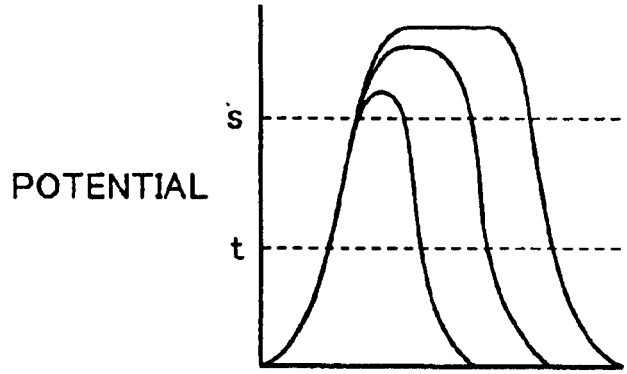
FIG. 15 is a diagram to describe that the development saturation level is exceeded even for dots in the lower gray scale level by reducing the laser spot.
Figure 16:
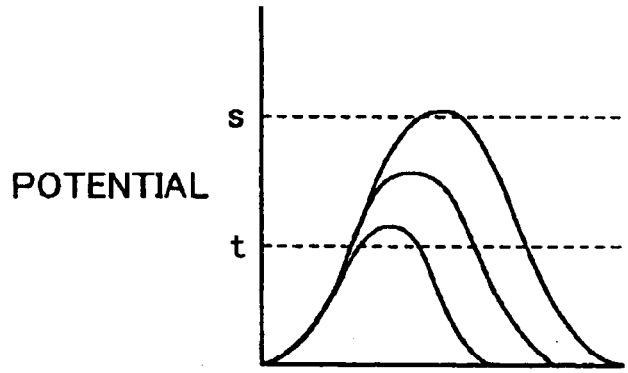
FIG. 16 shows the potential distribution at a toner layer face of one dot by a latent image on a photoreceptor, formed by pulse-width modification, in the case where the dot pitch is small.
Figure 17:
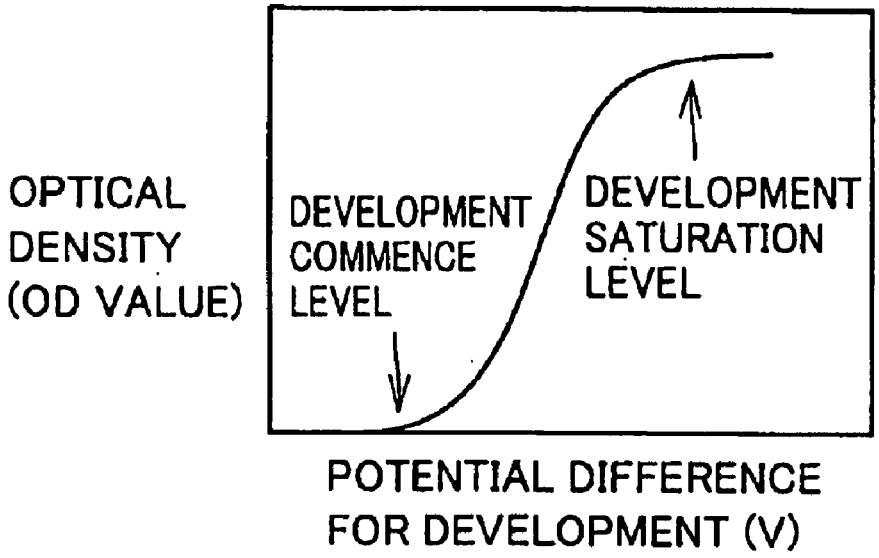
FIG. 17 shows general developing characteristics.

Development belt 41*e* is movable by the rotation of belt support roller 41*c* and development bias roller 41*d*. Development belt 41*e* is formed of a 300 μm-thick silicon rubber sheet having a resistance value of approximately $10^8\Omega\cdot$cm. Belt support roller 41*c* is a roller molded by insulative resin. Belt support roller 41*c* has electrodes A and B printed at its surface in a line width of 200 μm and at the pitch of 1.5 mm, as shown in FIG. 11. The two sets of electrode lines A and B of every other one line are respectively connected at the left and right ends of roller 41*c*.

Development bias roller 41*d* is configured with a conductive layer of low elasticity provided around a metal shaft. Development bias roller 41*d* is located at a position facing photoreceptor 1. A development bias voltage is applied to the metal shaft. Charge generation device 45 is located at a position facing the region where development belt 41*e* is supported in contact with belt support roller 41*d*. Charge generation device 45 has a structure similar to the structure described in the second embodiment.

The remaining structure of the present embodiment is substantially similar to the structure of the first embodiment. The same components have the same reference characters allotted, and description thereof will not be repeated.

The manner during operation of the toner charging region will be described with reference to FIG. 11.

A voltage of −100V is applied to the set of electrodes A on belt support roller 41*c* whereas a voltage of 0V is applied to the set of electrodes B at the other side end in the drawing. At the site where roller 41*c* is in contact with development belt 41*e*, current flows from electrode A to electrode B. By this potential drop of current, the voltage exhibits a substantially linear change from −100V to 0V from the site where development belt 41*e* forms contact with electrode A to the site where development belt 41*e* forms contact with electrode B.

Since −100V is applied as the bias voltage to charge generation device 45, almost no charge is applied to toner 10 located at development belt 41*e* applied with −100V. In contrast, toner 10 located at development 41*e* at the site of 0V is heavily charged to result in increase of the charging amount. The specific charge of toner 10 on development belt 41*e* when charge generation device 45 is not operated is approximately −20 μC/g whereas the average specific charge when charge generation device 45 is operated is approximately −45 μC/g. Therefore, it is assumed that a toner layer of approximately −20 to −70 μC/g is formed on development belt 41*e*.

By forming toner 10 of large specific charge and toner 10 of small specific charge on a single developer carrier 41*e*, advantages similar to those of the above-described first to fourth embodiments can be obtained. An image of favorable picture quality can be obtained using developing device 4*f*.

As a modification of altering the specific charge of toner on one developer carrier, two types having different average grain size, or two types having different charge control agent can be mixed. The advantage similar to that described above can be obtained although the position is random. Here, adjustment can be made so that the flowability of the toner with the larger specific charge is increased by using an additive such as fine silica particles. An alternating voltage is superposed on the direct-current voltage as described above as the development bias. Small dots can be formed by development using the toner of low specific charge (i.e., toner of smaller increasing ratio of development density to increase of the potential difference for development), followed by using the toner of larger specific charge (i.e., toner of larger increasing ratio of development density to increase of the potential difference for development). Thus, small dots can be formed stably at the low density region, and solid black density of a sufficient level can be achieved at the high density region.

According to the development method and image formation apparatus of the present invention, fine or low density dots without graininess can be formed at the low density region and sufficient density can be achieved at the high density region without excessive load on the optical system. Thus, development can be conducted stably and the quality of the image can be improved.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A development method conducted by an image formation apparatus including an electrostatic latent image carrier carrying an electrostatic image, and first and second developer carriers respectively carrying a developer at their surface, and facing said electrostatic latent image carrier at a respective developing region, wherein an increasing ratio of development density to increase of potential difference between said first developer carrier and said electrostatic latent image carrier is small, such that it is smaller than the increasing ratio of development density to increase of potential difference between said second developer carrier and said electrostatic latent image carrier, said first developer carrier being disposed upstream of said second developer carrier in a moving direction of said electrostatic latent image carrier, comprising steps of:

forming dots for a low density portion of said electrostatic latent image using said first developer carrier in the region of said increasing ratio of development density to increase of potential difference between said first developer carrier and said electrostatic latent image carrier, and forming dots for a high density portion of said electrostatic latent image using said second developer in the region of said increasing ratio of development density to increase of potential difference between said second developer carrier and said electrostatic latent image carrier, wherein an upper limit of said low density portion is defined as an upper limit of said development density at said region where the increasing ratio of development density is small of substantially 0.3, and wherein said upper limit of said low density portion is a lower limit of a high density portion.

* * * * *

UNITED STATES PATENT AND TRADEMARK OFFICE

CERTIFICATE OF CORRECTION

PATENT NO. : 6,873,813 B2
DATED : March 29, 2005
INVENTOR(S) : Kazuhiko Furukawa et al.

It is certified that error appears in the above-identified patent and that said Letters Patent is hereby corrected as shown below:

Title page,
Item [73], Assignee, correct to -- Sharp Kabushiki Kaisha, Osaka (JP) --.

Signed and Sealed this

Twenty-third Day of August, 2005

JON W. DUDAS
*Director of the United States Patent and Trademark Office*